United States Patent [19]

Kobayashi

[11] 3,935,680

[45] Feb. 3, 1976

[54] METHOD FOR VIBRATORY FINISHING WORKPIECES UNDER HEAVILY COMPRESSED CONDITION

[75] Inventor: Hisamine Kobayashi, Nagoya, Japan

[73] Assignee: Shikishima Tipton Mfg. Co., Ltd., Nagaoya, Japan

[22] Filed: May 14, 1974

[21] Appl. No.: 469,888

Related U.S. Application Data

[62] Division of Ser. No. 351,966, April 17, 1973.

[30] Foreign Application Priority Data

Apr. 17, 1972 Japan ..... 47-38474

[52] U.S. Cl. ..... 51/313; 51/163 V

[51] Int. Cl.[2] ..... B24B 1/00; B24B 31/06

[58] Field of Search ..... 51/313, 316, 7, 163, 293

[56] References Cited

UNITED STATES PATENTS

| | | | |
|---|---|---|---|
| 3,214,871 | 11/1965 | Olson et al. | 51/316 |
| 3,466,815 | 9/1969 | Balz | 51/313 |
| 3,527,000 | 9/1970 | Carter | 51/316 |
| 3,550,326 | 12/1970 | Robinson | 51/513 |
| 3,553,900 | 1/1971 | McKibben | 51/313 |
| R27,084 | 3/1971 | Balz | 51/313 |

*Primary Examiner*—Harold D. Whitehead

*Attorney, Agent, or Firm*—Wenderoth, Lind & Ponack

[57] ABSTRACT

A method for finishing workpieces which are caused to flow in a helical motion together with abrasive media within a circular vibratory finishing tub in the form of a hollow annulus closed at both ends, and more particularly for vibratory finishing of workpieces together with abrasive media in a heavily compressed condition and for separating the mass (a mixture of workpieces and abrasive media) into workpieces and abrasive media. The apparatus for carrying out the method has a downwardly inclined or horizontal circular vibratory finishing tub having an opening at the top which is closed in operation, in the form of a hollow annulus, having the radially greatest sectional area at the central portion thereof and the sectional area being gradually smaller toward both ends thereof, so that the mass is caused to flow during vibration with an increased density resulting in a substantially compressed condition of the mass so that workpieces and abrasive media are caused to move in a closely spaced relation which would otherwise be eliminated at every vibration. By this arrangement the vibrating pressure and action between workpieces and abrasive media are improved and the mass separating efficiency as well as the smoothness of the finished surfaces are also improved considerably.

5 Claims, 8 Drawing Figures

METHOD FOR VIBRATORY FINISHING WORKPIECES UNDER HEAVILY COMPRESSED CONDITION

This application is a divisional application of my copending application Ser. No. 351,966 filed Apr. 17, 1973.

BACKGROUND OF THE INVENTION

In a conventional finishing apparatus having a circular vibratory finishing tub, the finishing operations are performemd with the tub open at the top to facilitate a visual inspection of the flowing mass. However, this causes the disadvantage of limiting the volume of workpieces which can be finished, causing damage or defects to the workpieces due to the impact thereof with each other, the media and the tub under strong vibration and reducing the mass separating efficiency due to the backflow of the mass.

There are conventional finishing apparatuses having a circular vibratory finishing tub, a rotary barrel or mill, a centrifugal barrel, or a vibratory finishing tub or box type in which the barrel or the like is closed in operation. However, all of those apparatuses provide only a means of closing the barrel or the like without which it would be impossible to operate the apparatus since the contents would otherwise be easily vibrated out, or a means of closing the barrel or the like to prevent water from the finishing compound from spattering out. In other words, this is simply a covering means, but not a means of finishing workpieces effectively by vibration under a heavily compressed condition as in this invention.

SUMMARY OF THE INVENTION

With the method according to the invention, an increased volume of workpieces can be finished and the smoothness of the finished surfaces of workpieces is improved by placing the workpieces and abrasive media under a heavily compressed condition during vibration.

In order to meet these needs, the method carries out finishing in a circular vibratory finishing tub having an opening at the top which is closed in operation, and has the radially greatest sectional area at a central portion thereof before a dam and the radially smallest sectional area at that portion thereof beyond said dam.

Consequently, contents of the mass are caused to move in a closely spaced relation, and are mutually subjected to a heavy force by the vibration while passing through the portion of the smallest sectional area.

According to the invention, the tub is a downwardly inclined or horizontal circular vibratory finishing tub in the form of a hollow annulus having an opening at the top which in operation is closed, having the radially greatest sectional area, other than the mass separating portion, at that portion thereof before a dam and a sectional area which is gradually smaller toward both ends thereof, one end having the smallest sectional area at that portion beyond or downstream of the dam and the other end having a medium sectional area at that portion connected to the mass separating portion, so that contents of the mass are caused to move in a closely spaced relation and are thus subjected to a heavy force by the vibration while moving inside the tub.

Consequently, it is possible to handle double the volume of the mass and improve the smoothness of the finished surfaces by reducing substantially by half the roughness thereof. This can thus proctect workpieces from damage or defects due to the impact thereof with each other, the media or the apparatus. Furthermore, this increased volume and improved smoothness brings the finishing efficiency to substantially four times that of the conventional apparatus. In using the machine for a mill, not only can the deviation of the milled particles from the desired sizes be reduced, but the efficiency can be increased. This finishing efficiency cannot be obtained from the prior art vibratory finishing apparatuses for handling metals or ores or the like. In other words, these prior apparatuses are usually capable of increased efficiency for polishing, milling and mixing purposes, but for that increase must sacrifice the smoothness of the finished surfaces.

According to this invention, it is possible not only to increase the volume of the processing mass, but also to improve the finishing efficiency and smoothness of the finished surfaces.

As has been described heretofore, the invention provides an improved finishing efficiency by increasing the smoothness of the finished surfaces, and also a reduction of substantially half the amount of deviation of the milled grain sizes from the desired sizes, in addition to an increased volume of workpieces which can be finished. Thus, it provides a completely novel performance by bringing the whole efficiency to substantially four times that of the prior art.

When the mass is fed by a charge port into the tub of the present apparatus, it is subjected to vibration and is caused to travel in a helical motion. During the finishing operation, the mass is caused to move upwardly along the dam and when the operation is completed, it is caused to move up to a sieve along a movable flap which has been moved downwardly, and on the sieve the mass is separated into workpieces and abrasive media. The abrasive media is again fed through the sieve into the tub by action of gravity.

This invention is characterized in that the circular vibratory finishing tub having an opening at the top to be closed in operation comprises two portions with radially different sectional areas, so that the mass is caused to move inside the tub under a heavy compression force by the vibration.

As compared with the operation of a conventional apparatus having a vibratory finishing tub open or closed at the top by which the mass is uniformly subjected to vibration, the method according to the invention carries out finishing in a circular vibratory finishing tub having the radially greatest sectional area at that portion before the dam and the radially smallest sectional area at that portion over said dam, so that the mass flowing under vibration toward the smallest sectional area is subjected to compression from the barrel wall and substantially heavy compression force by vibration. When it is supposed that the greatest sectional area at that portion before the dam is E, the smaller sectional area at the portion after the mass separating portion F should preferably be smaller than E but greater than 0.8 E, the optimum being more or less 0.9 E. Then, suppose the smallest sectional area is G, G should be within the range of $0.9\ E>G>0.5\ E$, the optimum being within the range of 0.8 E to 0.6 E.

Consequently, it is possible to obtain a considerably improved finishing efficiency by controlling values of these two sectional areas inside the tub.

BRIEF DESCRIPTION OF THE ACCOMPANYING DRAWINGS

DETAILED DESCRIPTION OF THE INVENTION

According to the invention, a dam is provided to separate a circular vibrating finishing tub into two portions, one having the radially greatest sectional area and the other having the radially smallest sectional area, so that the mass moving inside the tub can be finished or milled by vibration under a heavy compression force with a substantially improved efficiency.

Figure 1:
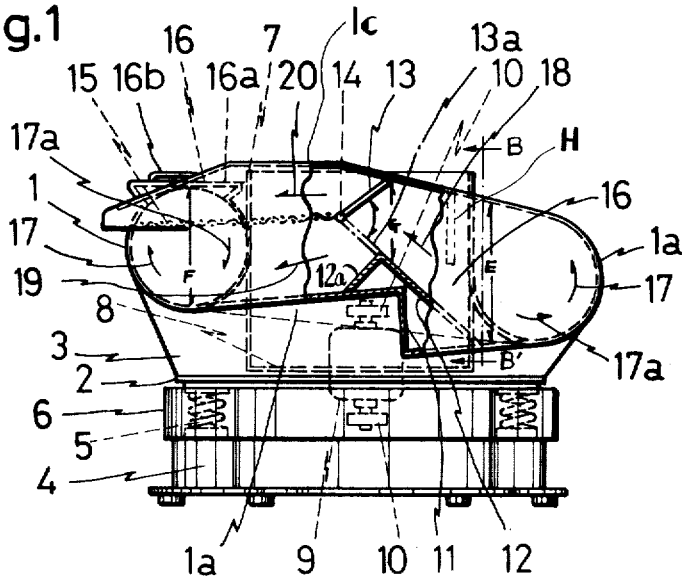
FIG. 1 is a front view of one apparatus according to this invention.
Figure 2:
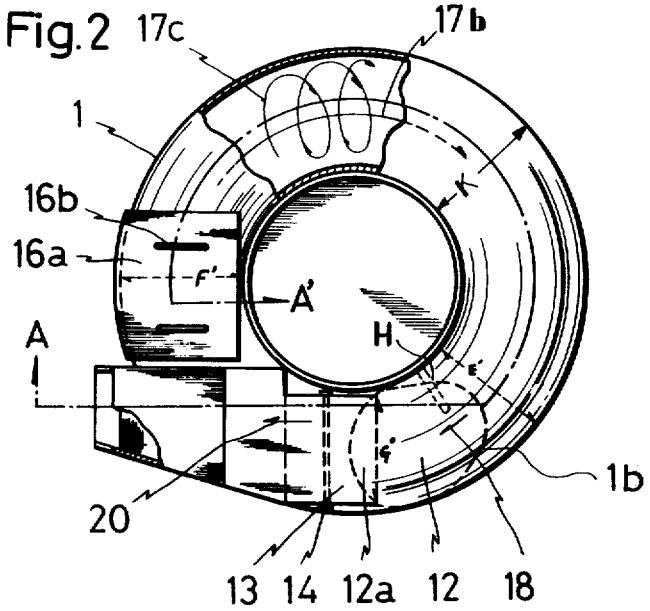
FIG. 2 is a plan view of the apparatus of FIG. 1.

In the drawings, in FIGS. 1 and 2 is shown the upper end 1 of a circular vibratory finishing tub placed in a downwardly inclined position. The tub has a descending part 1*a*, an ascending part 1*b*, and a separating part 1*c*, respectively.

Figure 4:
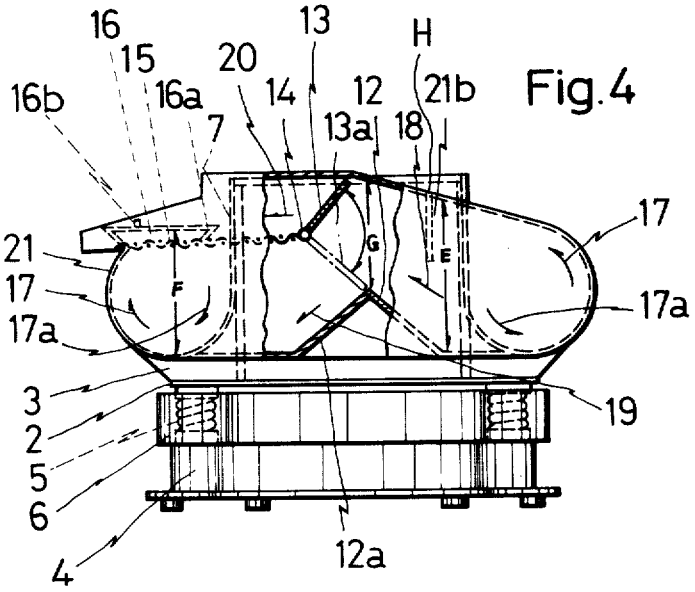
FIG. 4 is a front view of another apparatus according to this invention.
Figure 5:
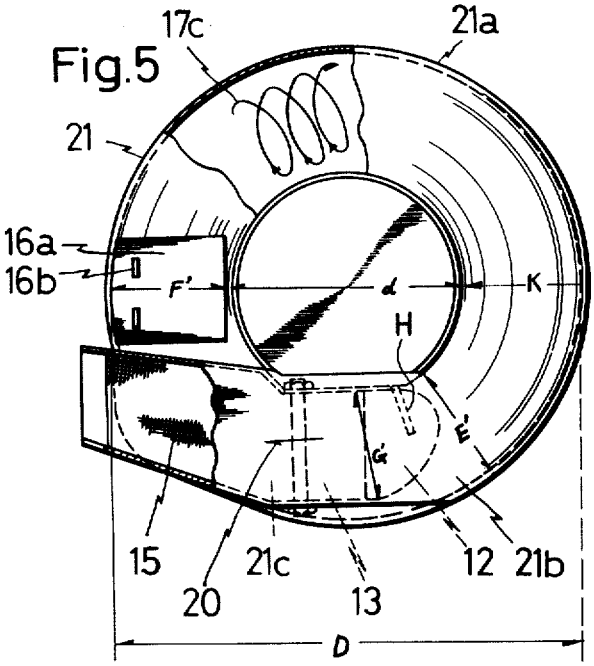
FIG. 5 is a plan view of the apparatus of FIG. 4.

In FIGS. 4 and 5 is shown a circular vibratory finishing tub 21, 21*a* placed in a substantially horizontal position, which has an ascending part 21*b* and a separating part 21*c*.

Figure 7:
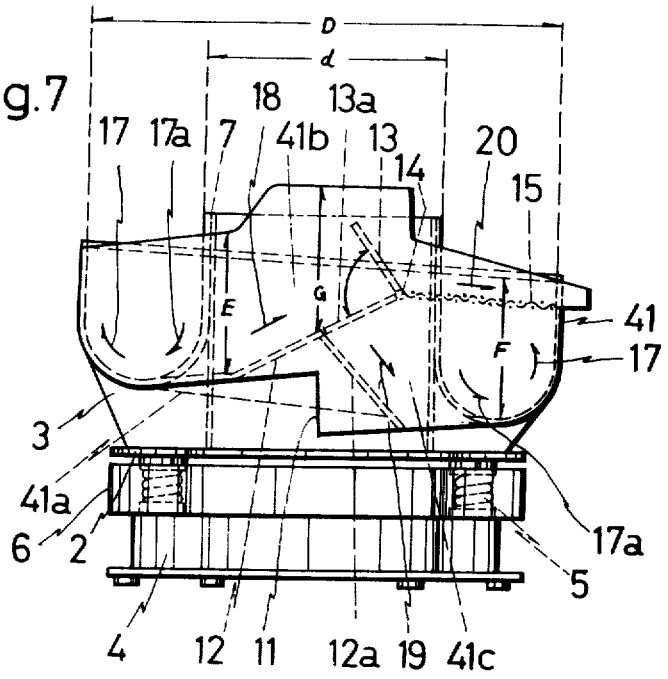
FIG. 7 is a front view of one conventional apparatus.
Figure 8:
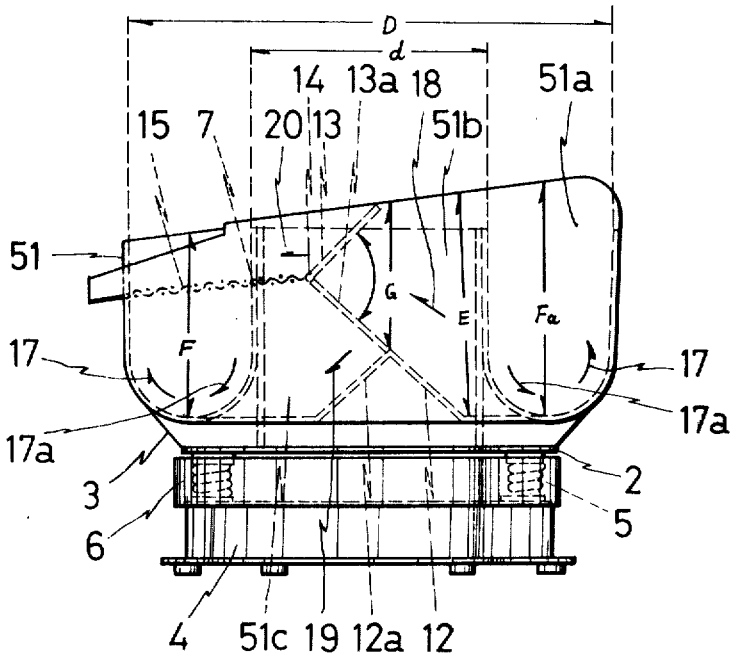
FIG. 8 is a front view of another conventional apparatus.

For the convenience of reference, two conventional apparatuses having a circular vibratory finishing tub open at the top are shown in FIGS. 7 and 8. In FIG. 7 the upwardly inclined tub has a lower end 41 open at the top, an ascending part 41*a*, an ascending part 41*b* over the dam, and a separating part 41*c*.

In FIG. 8, a horizontal circular vibratory finishing tub 51, 51*a* is open at the top and has an ascending part 51*b* over the dam and a separating part 51*c*.

By referring to the reference numerals common to all drawings, we will illustrate the structure of the apparatus.

The circular vibratory finishing tub is rigidly secured by a rib 3 to a flange 2 and mounted by a plurality of springs 5 on a pedestal 4. An electric motor 9 is vertically fixed to a flange 8 within a cylindrical housing 7.

When the motor 9 is started, it causes weights 10, rigidly secured to the motor shaft, to rotate and then vibrate the tub and the mass therewith. A superposed portion 11 is provided for the descending portion of the tub of FIGS. 1 and 2, and for the ascending portion of the tub of FIG. 7, respectively.

A dam 12 is rigidly secured on said superposed portion 11. A dam is also provided for the horizontal tub of FIGS. 4 and 8. This dam is preferably of an angular shape having an ascending part 12 and a descending part 12*a*. A dam having only one plate may be provided vertically, or only that portion of the angular-shape dam facing the flow direction of the mass may be provided with an ascending part.

Apart from the shape of the dam, the most important thing of the invention is that the ratio of the sectional area at one point to that at the other point inside the tub should be maintained within the range of a given value.

By the structure of the invention, it is possible to cause the mass to travel smoothly inside the tub and to reduce the vibrating width or amplitude of the mass to a small amount by increasing the density of the mass, thus subjecting the mass to a heavy compression force during vibration.

A cover 6 encloses a plurality of helical springs 5. A movable flap 13 is placed in such a position that it does not prevent movement of the mass 13a indicating a position which the flap 13 takes in turning on its shaft 14 when the mass is being separated. A sieve 15 is provided for seprating the mass. A mass charging port 16 is provided with a cover 16*a* having a grip 16*b*. In operation, the port 16 is closed by the cover 16*a*. This port 16 is provided as indicated in FIG. 1 near to that portion of the tub where the mass is entering the finishing portion after passing through the separating portion.

When the mass is fed through the port 16 into the tub, it is subjected to vibration, flowing in a helical motion in the direction of the arrow 17*b* revolving inside the tub as indicated by the arrows 17 and 17*a*. Then, the mass moves up along the dam as indicated by the arrow 18 and continues to flow beyond the dam as indicated by the arrow 19, where the mass receives the finishing operations.

Figure 3:
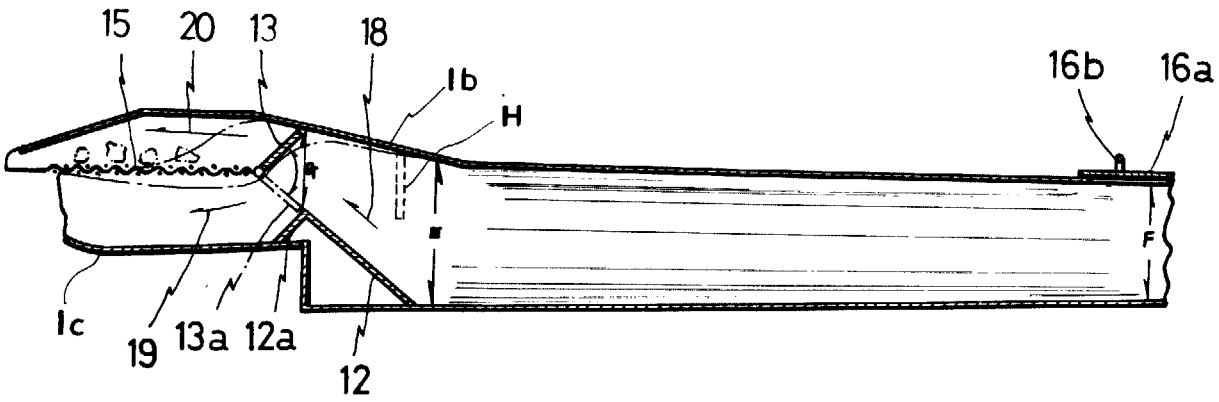
FIG. 3 is a fragmental developed sectional view taken along the line A—A of FIG. 2.

When the finishing operations are completed, the flap 13 rotates on its shaft to the position as indicated by dot-dash lines 13*a* of FIGS. 1 and 3 to move the mass up to the sieve 15 where the mass is separated into workpieces and abrasive media. The media are screened through the sieve to be fed again into the tub. The finished workpieces are automatically ejected out of the tub as indicated by the arrow 20.

For the circular vibratory finishing tub open at the top, as shown in FIGS. 7 and 8, there is no need of such a port for charging a mass. Motors, weights, and other component parts that are the same as in FIG. 1 are not indicated in FIGS. 7 and 8, but naturally these are also installed on the apparatus of FIGS. 7 and 8.

This invention is particularly characterized in that the circular vibratory finishing tub comprises one portion before the dam having the radially greatest sectional area and one portion over the dam having the radially smallest sectional area, so that the mass is caused to move under a heavy compression force during vibration. In the conventional apparatus having a circular vibratory finishing tub, open or closed at the top, vibration of the mass is caused uniformly. According to the invention, however, a circular vibratory finishing tub is provided in the form of a hollow tubular container having a gradually smaller sectional area toward both ends, having one portion before the dam having the radially greatest sectional area, one portion over the dam having the radially smallest sectional area, and one portion connecting to the separating portion having a radially medium sectional area, so that the vibration given to the whole mass exerts on the mass a substantially compressing force. The mass is thus caused to move under such heavy compressing force during vibration.

The widths E′, F′, G′ of the tub at the various portions, except the separating portion, are the same as indicated in FIG. 2. The portion E of the tub before the dam has the greatest depth, and the depth of portion F after the separating portion should be smaller than E and greater than 0.8 E, the optimum being more or less 0.9 E. The depth of portion G over the dam should preferably be 0.9 E>G>0.5 E, the optimum being within the range of 0.8 E to 0.6 E, namely E>F>G and, accordingly, EE'>FF'>GG'.

When the tub and the mass therein are subjected to vibration, i.e. a vibration equivalent to about 6 mm in amplitude, the vibrating width or amplitude is compressed so as to be substantially smaller than 6 mm and greater than 3 mm. In the conventional apparatus of this type, the amplitude generally ranges from 8 mm to 3 mm, but in this invention it is possible to obtain an amplitude of 6 mm to 2 mm by compressing it by 1 mm to 3 mm. In this way, workpieces can be polished or finished under heavy compression force during vibration. The vibration thus obtained differs greatly from that of the prior art in the finishing efficiency, since the former offers substantially four times higher performance than the latter.

As a result, it is possible to improve the finished surfaces of workpieces, doubling the efficiency for finishing workpieces and reducing the deviation of the sizes of milled grain from the desired size. This equals four times higher finishing efficiency, which is evident from the Tables 1–4 that follow hereinafter.

As can be seen from the above tables, the finishing efficiency of the invention differs greatly from that of the conventional apparatus, which is due to the fact that the inner diameter D of the outer periphery of the tub and the outer diameter *d* of the inner periphery thereof have a common size, respectively, in all types, the inside arcuate bottom being uniform, and that the radially sectional portions E', F' and G' have the same width, while these portions have radially different sectional areas depending on the depth E, F and G thereof.

In the embodiments of the apparatus according to this invention, suppose the portion E is 1, then the portions F and G should be E>F>0.8 E and 0.9 E>G>0.5 E, respectively, resulting in E>F>G.

In this way, when the mass is charged in an amount sufficient to fill the greatest sectional space ahead of the dam it will thus be compressed in moving from the portion F toward the portion G over the dam having radially the smallest sectional area. However, in the apparatus according to one embodiment of the prior art (FIG. 7), E, F and G are equal, while in the apparatus according to the other embodiment of the prior art (FIG. 8), F*a*, E, F and G are different, and F*a*->E>F>G, the portion E not being the greatest in sectional area in this apparatus.

It is clear that the structure of these portions E, F and G of the conventional apparatus differs from that of the apparatus of the invention.

According to the apparatus of the prior art, the structure and function are not such as to compress the moving mass during either the finishing or separating operations. Because of this, higher inner walls must be provided for the inner and outer peripheries of the tub so as to prevent the overflow of the mass moving onto the stationary and movable dams during the separating operations. This causes the mass to flow backward, resulting in a considerably decreased separating efficiency and more frequent damage or defects due to the impact thereof.

According to this invention, however, the two portions ahead of and over the dam are provided with a different radially sectional area, i.e. E>F>G and the ratio among E, F and G is properly determined so that the mass may be subjected to heavy compression force during vibration, namely the finishing operations can be performed under a high compression force. In addition, this invention can protect workpieces from any type of damage or defect due to the impact thereof, and can also minimize noises since in operation the tub is closed by a cover.

Tests have been effected under about the same finishing conditions with regard to these four apparatuses in which three samples or brass, iron and stainless steel have been used. Then, comparison has been made with respect to the weight of workpieces to be finished and the smoothness of the finished surfaces thereof, on the basis of the capabilities of the conventional apparatuses, the results of which have been obtained, as follows:

The weight according to the embodiments of the present invention has reached 209 to 153%, respectively, as compared with that of the conventional apparatus, the surface roughness reaching 1.5 to 0.7$\mu$. The apparatus of FIGS. 1–3 in particular has shown the best results, i.e. a weight of 209 to 153% and a surface roughness of 1.3 to 0.7$\mu$.

Table 4 also shows the remarkably significant difference in the milling efficiency between the prior art apparatus of FIG. 7 and that of FIGS. 1–3 of the present invention.

In a milling test on bauxite ores (mined in Guinea) using the apparatus of FIGS. 1–3 and continuing, the test was continued for 48 hours and in the resulting material the amount of deviation from the desired particle size ranged from 10$\mu$ to 2$\mu$ for 67% and from 60$\mu$ to 10$\mu$ for 21% of the total amount of material, respectively, whereas in the apparatus of FIG. 7, the amount of deviation was only within the range of 60$\mu$ to 10$\mu$ for 47% of the material.

Figure 6:
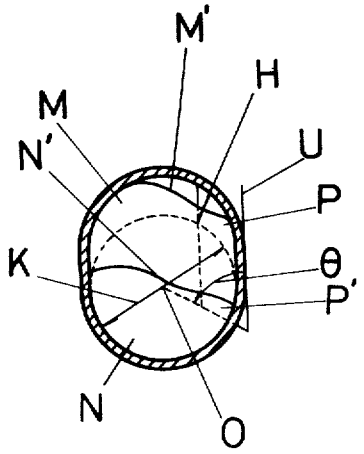
FIG. 6 is a sectional view taken along the line B—B of FIG. 1.

However, in order to make the best use of these efficiencies for the finishing and milling operations, or for any amount of the mass remaining inside the tub, it is desirable to provide a plate H inside the tub for preventing the backflow of the mass, as indicated in FIG. 6.

When the mass is moving upwardly along the ascending side 12 of the dam, the upper part P of the mass flowing on the inner peripheral side of the tub is apt to flow backward. As the volume of the mass becomes smaller after further separating operations, the remaining mass is more apt to flow backward.

The ratio in which a given volume of workpieces are mixed with abrasive media or the like is usually 1 to 3 or 2. When workpieces and abrasive media are mixed in this ratio, the finishing and separating operations are more easily performed in the apparatus of the invention. By providing the aforesaid plate for preventing the backflow of the mass, it is possible to improve the ratio further, i.e. the ratio of 1 for workpieces and 2 or 1 for abrasive media. This means that the finishing and separating operations can be improved by substantially fifty percent and the time required for the separating operations can, accordingly, be reduced considerably.

Because of the presence of the plate H for preventing the backflow of the mass as shown in FIG. 6, the upper part M' of the mass M forces the mass M to remain on the down stream side (side G of FIG. 4) of the plate H, keeping the mass filling the space between the portions E and G until the upper part M' moves down to a level N' on the upstream side (side F of FIG. 3) of the plate H, thus enabling the mass to be separated into workpieces and abrasive media effectively. At this stage, workpieces alone are ejected out of the tub.

The volume N of the mass that remains on the upstream and downstream sides of the plate H after completion of the separating operation will be equivalent to M/2, from which it is evident that the maximum separating volume M/3 of the conventional apparatus has been improved by substantially 50%.

The size, shape and position of installation of the plate H should be such that it is placed nearer to the portion E along the distance between the portions E and G and on the radially inside inner peripheral wall of the tub having a width of about K/4 and a height of about K (K is the width of the tub), the lower end portion being inclined at an angle $\theta$ (more or less 60°) obtained by intersecting a line passing through the center O of a circle K and a perpendicular line U as shown in FIG. 6. The plate H should also be such that the major portion of the inside arcuate bottom of the tub is not shut off but open, so as to force the mass up to the downstream side of the plate H, thus preventing the mass from flowing back from the downstream side of the upstream side.

In the apparatus of the invention comprising a downwardly inclined circular vibratory finishing tub having an opening at the top to be closed during operation, a separating device is provided at the top of the upper portion of the tub indicated by 15 in FIGS. 1 and 3. The distance between the sieve and the bottom of the tub is smaller than the width of the tub, which is equivalent to substantially half the distance between the separating device (indicated by 15 in FIGS. 7 and 8) and the bottom of the tub in the conventional apparatus. This makes it possible to avoid occurrence of damage to or defects in the workpieces due to the impact thereof, also providing a good finishing efficiency for aluminum bronze, zinc diecast, and other soft metals.

TABLE 1

| MACHINE TYPE | CAPACITY | Finishing Conditions: FREQUENCY cpm | AMPLITUDE | ADVANCE ANGLE OF LOWER WEIGHT | SAMPLE: WORKPIECE | DISK SHAPE | QUANTITY |
|---|---|---|---|---|---|---|---|
| (1) | 100L | 1730 | 5.5 mm | 90° | Brass, iron, stainless steel | 30 mm × 8tmm | 5 each |
| (2) | " | " | " | " | " | " | " |
| (3) | " | " | " | " | " | " | " |
| (4) | " | " | " | " | " | " | " |

1. As the inner diameter (D) of the outer circumference and the outer diameter (d) of the inner circumference are nearly the same for all types, the width E', F' and G' in the direction of the radium of the arcuate bottom of the tub is almost the same at 240 mm. The vertical section in the direction of the radium of the tub is almost proportional to the depth E, F and G of the space inside the tub, except the separating portion.
2. Fa denotes an exceptional case for type (2) in which the depth inside the tub is greater than in E and F.
3. Type (3) of this invention is superior in finishing efficiency, which is clear from the following experimental results, Table 2.

CHARGE

| ABRASIVE MEDIA | COMPOUND and WATER |
|---|---|
| AES - 3140 kg | GCL 50g/5l(water) |
| " | " |
| " | " |
| " | " |

| TYPE | DIAMETER OF TUB: D | d | DEPTH OF TUB: E | | F | Ratio | G | Ratio | Fa | | Ratio |
|---|---|---|---|---|---|---|---|---|---|---|---|
| (1) | 920 mm | 460 mm | 240 mm | 1 | 240 mm | 1 | 240 mm | 1 | mm | — | Ratio |
| (2) | " | " | 370 | 1 | 300 | 0.81 | 250 | 0.68 | 390 | | 1.05 |
| (3) | " | " | 230 | 1 | 207 | 0.9 | 140 | 0.61 | — | | — |
| (4) | " | " | 250 | 1 | 200 | 0.8 | 180 | 0.78 | — | | — |

TABLE 2

| | Type | | EXPERIMENTAL RESULTS (1) Brass mg | % | Iron mg | % | Stainless Steel mg | % | (2) Brass mg | % | Iron mg | % | Stainless Steel mg | % |
|---|---|---|---|---|---|---|---|---|---|---|---|---|---|---|
| Finishing | STOCK REMOVAL | 1st | 27.5 | — | 13.9 | — | 10.0 | — | 28.5 | — | 14.2 | — | 10.5 | — |
| | | 2nd | 26.9 | — | 15.7 | — | 11.8 | — | 27.2 | — | 14.9 | — | 11.7 | — |
| | | 3rd | 28.1 | — | 13.5 | — | 9.2 | — | 29.0 | — | 14.6 | — | 10.2 | — |
| Efficiency | | Average | 27.5 | 100 | 14.4 | 100 | 10.3 | 100 | 28.2 | 103 | 14.6 | 101 | 10.8 | 103 |
| | | Surface Roughness | 2.4μ | | 1.9μ | | 1.5μ | | 2.5μ | | 20μ | | 1.7μ | |

TABLE 2-continued

| Type | | | EXPERIMENTAL RESULTS (3) | | | | | | (4) | | | | | |
|---|---|---|---|---|---|---|---|---|---|---|---|---|---|---|
| | | | Brass | | Iron | | Stainless Steel | | Brass | | Iron | | Stainless Steel | |
| | | | mg | % | mg | % | mg | % | mg | % | mg | % | mg | % |
| Finishing | STOCK REMOVAL | 1st | 57.5 | — | 25.7 | — | 15.6 | — | 54.6 | — | 26.1 | — | 14.7 | — |
| | | 2nd | 55.7 | — | 28.1 | — | 16.0 | — | 57.2 | — | 26.5 | — | 15.6 | — |
| | | 3rd | 59.2 | — | 28.0 | — | 15.9 | — | 55.8 | — | 27.2 | — | 15.0 | — |
| Efficiency | | Average | 57.5 | 209 | 27.3 | 189 | 15.8 | 153 | 55.8 | 203 | 26.6 | 185 | 15.1 | 147 |
| | | Surface Roughness | 1.3μ | | 0.8μ | | 0.7μ | | 1.4μ | | 0.9μ | | 0.7μ | |

TABLE 3

| Type | Milling Condition Sample | | | Media | Water |
|---|---|---|---|---|---|
| | Description | Shape | Quantity | | |
| (1) | Calcinated Bauxite Ores (mined in Guinea) | Massive 10,000 to 100μ | 30l | Alumina Ball 30mmϕ, 60l | 5l |
| (3) | do. | do. | 30l | do. | 5l |

Note 1

1. Type (1) is a conventional finishing apparatus having an upwardly inclined circular vibratory finishing tube with a step open at the top, Model CCL-100, as shown in FIG. 7.
2. Type (2) is a conventional finishing apparatus having a horizontal circular vibratory finishing tub open at the top, Model CL-100, as shown in FIG. 8.
3. Type (3) is a finishing apparatus according to the invention having a downwardly inclined circular vibratory finishing tub, Model CSS-100, as shown in FIGS. 1, 2 and 3.
4. Type (4) is a finishing apparatus of the invention having a horizontal circular vibratory finishing tub, Model CRS-100, as shown in FIGS. 4 and 5.

Note 2

The above four types (1) to (4) are manufactured by Shikishima Tipton Manufacturing Company, Ltd.

Note 3

The experimental results have been obtained at the laboratory of this company.

Note 4 -- Test Time

Thirty minutes for each finishing test and 48 hours for each milling test.

TABLE 4

| Milling | Type | Experimental Results (1) | | (2) | |
|---|---|---|---|---|---|
| Efficiency | Sample | Bauxite 30l | | Bauxite 30l | |
| | Grain Dispersion | 5μ to 60μ | 47% | 2μ to 10μ | 67% |
| | | Longer than 60μ | 53% | Longer than 60μ | 12% |

What is claimed is:

1. A method for vibratory finishing of workpieces under heavy compression during vibration, comprising vibrating a mass including workpieces and abrasive media for causing the mass to flow in a helical motion along an annular path the cross-section of which is closed throughout the annular length thereof while gradually expanding the cross-sectional area of the path from the start of the path toward the central portion of the annular length thereof and gradually decreasing the cross-sectional area toward the end of the path so that workpieces and abrasive media are caused to move in an increasing closingly spaced relation during their vibration toward the end of the path rather than be free during every vibrating cycle.

2. A method according to claim 1 in which said path is a downwardly inclined circular path, and further comprising closing the upper end of said path during vibration of said mass.

3. A method according to claim 2 further comprising, after completion of the finishing separating the workpieces from the mass in the lower end of the downwardly inclined path.

4. A method according to claim 1 in which said path is a horizontal circular path, and further comprising closing both ends of said path during vibration of said mass.

5. A method according to claim 1 further comprising blocking the backflow of the mass just upstream of the smallest cross-sectional area of the path.

* * * * *